US006824349B2

(12) United States Patent
Okudera et al.

(10) Patent No.: US 6,824,349 B2
(45) Date of Patent: Nov. 30, 2004

(54) VACUUM PUMP

(75) Inventors: Satoshi Okudera, Narashino (JP); Yoshiyuki Sakaguchi, Narashino (JP); Yasushi Maejima, Narashino (JP)

(73) Assignee: BOC Edwards Technologies Limited, Narashino (JP)

( * ) Notice: Subject to any disclaimer, the term of this patent is extended or adjusted under 35 U.S.C. 154(b) by 44 days.

(21) Appl. No.: 10/294,829

(22) Filed: Nov. 14, 2002

(65) Prior Publication Data

US 2003/0095863 A1 May 22, 2003

(30) Foreign Application Priority Data

Nov. 16, 2001 (JP) ..... 2001-352252

(51) Int. Cl.[7] ..... F04D 19/04
(52) U.S. Cl. ..... 415/9; 415/90; 415/143
(58) Field of Search ..... 415/9, 90, 143, 415/170.1, 174.2, 174.4, 200, 214.1

(56) References Cited

U.S. PATENT DOCUMENTS 2,060,593 A * 11/1936 Schaurte et al. ..... 470/11

FOREIGN PATENT DOCUMENTS

| | | |
|---|---|---|
| EP | 0887556 | 12/1998 |
| EP | 1030062 | 8/2000 |

OTHER PUBLICATIONS

Patent Abstracts of Japan, vol. 1996, No. 09, Sep. 30, 1996 JP 08114196 A (Mitsubishi Heavy Ind Ltd.) May 7, 1996.
Patent Abstracts of Japan, vol. 1999, No. 01, Jan. 29, 1999 JP 10274189 A (Shimadzu Corp), Oct. 13, 1998.

* cited by examiner

*Primary Examiner*—F. Daniel Lopez
*Assistant Examiner*—Dwayne White
(74) *Attorney, Agent, or Firm*—Adams & Wilks

(57) ABSTRACT

A vacuum pump is removably connected to the underside of a chamber for exhausting gas molecules from the chamber. The vacuum pump has a pump case having a flange extending circumferentially around a top portion thereof, a suction port and an exhaust port. Stator blades are fixedly mounted within the pump case, and a rotor is rotatably mounted in the pump case and has rotor blades alternately disposed with respect to the stator blades. A driving motor rotationally drives the rotor so that the rotating rotor blades coact with the stator blades to evacuate gas molecules from the chamber and pump the gas molecules from the suction port to the exhaust port. Bolt insertion holes are formed in the flange and each hole has a smaller diameter portion opening at a lower surface of the flange and a larger diameter portion opening at an upper surface of the flange which faces the underside of the chamber. Bolts extend through respective ones of the bolt insertion holes for removably connecting the flange of the pump case to the underside of the chamber, and buffer members are disposed in respective ones of the bolt insertion holes and surround at least a portion of the corresponding bolt in the region between the upper and lower surfaces of the flange.

19 Claims, 5 Drawing Sheets

VACUUM PUMP

BACKGROUND OF THE INVENTION

1. Field of the Invention

The present invention relates to vacuum pumps used in semiconductor manufacturing apparatus, and more particularly, the present invention relates to the structure of a vacuum pump for preventing a brittle fracture of a fastening bolt that connects the vacuum pump and a process chamber, which is caused by a damaging torque.

2. Description of the Related Art

In a process such as dry etching, chemical vapor deposition (CVD), or the like performed in a high-vacuum process chamber in semiconductor manufacturing step, a vacuum pump such as a turbo-molecular pump is used for producing a high vacuum in the process chamber by exhausting gas from the process chamber FIG. 1 illustrates the basic structure of such a vacuum pump. As shown in FIG. 1, the vacuum pump has a cylindrical pump case 1 having a bottom, and the pump case 1 has an opening at the top portion thereof serving as a gas suction port 2 and an exhaust pipe, at a lower part of the cylindrical surface thereof, serving as a gas exhaust port 3.

The bottom portion of the casing 1 is closed by an end plate 4, and a stator column 5 stands upright at a center portion of the internal bottom surface of the end plate 4.

A rotor shaft 7 is rotatably supported by an upper ball bearing 6 and a lower ball bearing 6 at the center of the stator column 5.

A driving motor 8 is arranged inside the stator column 5. The driving motor 8 has a structure in which a stator element 8*a* is disposed on the rotor shaft 7, and it is structured such that the rotor shaft 7 is rotated about the shaft.

A rotor 9, which covers the outer circumference of the stator column 5 and is formed in a section-shape, is connected to the upper portion protrusion end from the stator column 5 of the rotor shaft 7.

A plurality of rotor blades 10 are disposed and fixed to the upper part of the circumferential outer surface of the rotor 9, while a plurality of stator blades 11 are alternately disposed with respect to the rotor blades 10 and are fixed to each other inside the pump case 1 via ring spacers 11*a*.

The pump case 1 has a threaded stator 12 disposed and fixed under the blades 10 and 11 and around the rotor 9. The threaded stator 12 is formed in a tapered cylindrical shape so as to surround the outer circumferential surface of the lower part of the rotor 9 and its inner surface has a tapered shape, the inner surface of which has a diameter that gradually decrease downwardly. Also, the threaded stator 12 has thread grooves formed on the tapered inner surface thereof.

A flange 1*a* is formed along the circumferential uppermost portion of the pump case 1. The flange 1*a* is fitted on the peripheral end of an opening portion of the lower surface side of a process chamber (hereinafter, referred to as "chamber") 14 and a plurality of fastening bolts 15, which penetrate the flange 1*a*, are screwed in and fixed to the chamber 14, so that the pump case 1 is connected to the chamber 14.

Next, the operation of the foregoing vacuum pump will be described. In this vacuum pump, firstly, an auxiliary pump (not shown) connected to the gas exhaust port 3 is activated so as to evacuate the chamber 14 to a certain vacuum level. Then, the driving motor 8 is operated so as to rotate the rotor shaft 7, the rotor 9 connected to the rotor shaft 7, and the rotor blades 10 also connected to the rotor shaft 7 are rotated at high speed.

When the rotor blade 10 rotates at high speed, at the uppermost stage the rotor blade 10 imparts a downwards momentum to the gas molecules entering through the gas suction port 2, and the gas molecules with this downward momentum are guided by the stator blades 11 to be transferred to the next lower rotor blade 10 side. By repeating this imparting of momentum to the gas molecules and transferring operation, the gas molecules are transferred from the gas suction port 2 to the inside of the threaded stator 12 provided on the lower portion side of the rotor 2 in order. The above-described operation of exhausting gas molecules is called a gas molecule exhausting operation performed by the interaction between the rotating rotor blades 10 and the stationary stator blades 11.

The gas molecules reaching the threaded stator 12 by the above-described gas molecule exhaust operation are compressed from an intermediate flow state to a viscous flow state, are transferred toward the gas exhaust port 3 by the interaction between the rotating rotor 9 and the thread grooves formed inside the threaded stator 12 and are eventually exhausted to the outside via the gas exhaust port 3 by the auxiliary pump (not shown).

Incidentally, as structural materials of the casing 1, the rotor 9, the rotor blade 10 and the stator blade 11 or the like, which compose the vacuum pump, light alloy, in particular, aluminum alloy is normally employed in many cases. This is because aluminum alloy is excellent in machining and can be precisely processed without difficulty. However, the hardness of aluminum alloy relatively low as compared with other materials and aluminum alloy may cause a creep fracture depending on the operating condition. Further, a brittle fracture may occur in operation mainly caused by a stress concentration at the lower part of the rotor 9.

If the brittle fracture occurs in the rotor 9 during a high speed rotation, some of the rotor blades 10 integrally formed with the circumferential outer surface of the rotor 9 crash into the ring spacers 11*a* disposed on the circumferential inner surface of the pump case 1. Since the ring spacers 11*a* have insufficient strength against this smashing force, the smashing force causes the ring spacers 11*a* to expand in the radial direction thereof. When a sufficient clearance is not provided between the ring spacers 11*a* and the circumferential inner surface of the pump case 1, the expanded ring spacers 11*a* come into contact with the circumferential inner surface of the pump case 1, thereby producing a large damaging torque which causes the whole pump case 1 to rotate, and accordingly, this damaging torque causes the chamber 14 to be broken or the torsional moment due to the damaging torque causes the bolts 15 fastening the pump case 1 to the-chamber 14 to be broken by shearing.

Since such a damaging torque causes the contact surface of the flange 1*a* of the pump case with the chamber 14 to act as a sliding surface and two very large forces to be instantaneously exerted on a portion, lying in the vicinity of the contact surface, of the bolt shaft of each bolt 15 in opposite directions, the bolt 15 is easily broken at the foregoing portion acting as a breaking surface, thereby leading to the above-described shearing breakage. Once the bolt 15 is broken, since its bolt shaft cannot be extracted from the corresponding hole of the chamber 14, the bolt shaft left in the chamber 14 must be removed by tapping. Also, replacing the damaged vacuum pump with a new one is troublesome.

The present invention is made so as to solve the above-described problems. It is an object of the present invention to provide a vacuum pump which prevents a chamber and fastening bolts, connecting the pump to the chamber, from being broken even when a damaging torque occurs caused by a trouble in the pump, and which can be quickly replaced with a new one.

SUMMARY OF THE INVENTION

To attain the above described object, a vacuum pump according to the present invention comprises a pump case including a gas suction port formed at an upper surface of the pump case and a gas exhaust port formed at a lower part of the cylindrical surface of the pump case; a rotor rotatably supported by a stator column via a rotor shaft, wherein the rotor is provided with a plurality of rotor blades fixed to the circumferential outer surface of the rotor and the stator column is disposed upright in the pump case; a plurality of stator blades fixed to the circumferential inner surface of the pump case, the rotor blades and the stator blades being alternately disposed; a driving motor disposed between the rotor shaft and the stator column; a plurality of bolts for connecting a flange to the circumferential bottom portion of a chamber, wherein the flange is formed along the circumferential top portion of the pump case; and a plurality of bolt insertion holes having stages which increase in size step by step toward the fixing surface of the chamber.

In the vacuum pump having the above-described structure according to the present invention, when the damaging torque is generated, the shearing force at the upper edge of each step caused by the damaging torque moves upwards step by step and does not concentrate on one specific upper edge, and the shock caused by the damaging torque is absorbed during this time period. As a result, the bolt shaft of the bolt merely undergoes a plastic deformation, thereby preventing the damaging torque from being transferred to the chamber so that the chamber is prevented from being damaged, and also preventing the bolt from being broken.

The vacuum pump according to the present invention may further comprise a buffer member disposed between the inner wall of the bolt insertion hole and the bolt shaft of the corresponding bolt. With this structure, the buffer effect of the elastically deformed buffer member prevents the damaging torque from being transferred to the chamber so that the chamber is prevented from being damaged, and also prevents the bolt from being broken.

The vacuum pump according to the present invention may have a structure in which the bolt insertion hole may have two steps having large and small diameters and the buffer member may be disposed between the bolt shaft and the large step portion close to the chamber.

Alternatively, the vacuum pump may further comprise a washer disposed between the bolt head and the flange, and has a structure in which the buffer member has an insertion hole for the bolt shaft to pass therethrough, and the bolt shaft and the upper part of the buffer member having an enlarged inner diameter have a gap therebetween.

Still alternatively, the vacuum pump may have a structure in which the bolt insertion hole has a tapered shape which increases in size toward the fixing surface of the chamber and the buffer member having a truncated cone shape is disposed between the bolt shaft and the bolt insertion hole.

A variety of devised shapes and structures of the buffer members disposed between the bolt shaft and the bolt insertion hole prevent the damaging torque from being transferred to the chamber so that the chamber may be prevented from being damaged, and also prevent the bolt from being broken.

In the vacuum pump according to the present invention, the bolt is preferably an extending bolt comprising a reduced-diameter portion between the bolt head and the male-threaded portion thereof and the diameter of the reduced-diameter portion is preferably smaller than the root diameter of the male-threaded portion.

In the vacuum pump according to the present invention, the extending bolt is preferably screwed into the chamber such that the top of the reduced-diameter portion enters the chamber by the length of one or two threads of the bolt.

In the vacuum pump according to the present invention, the buffer member may be composed of a rubber material.

DESCRIPTION OF THE PREFERRED EMBODIMENTS

Figure 1:
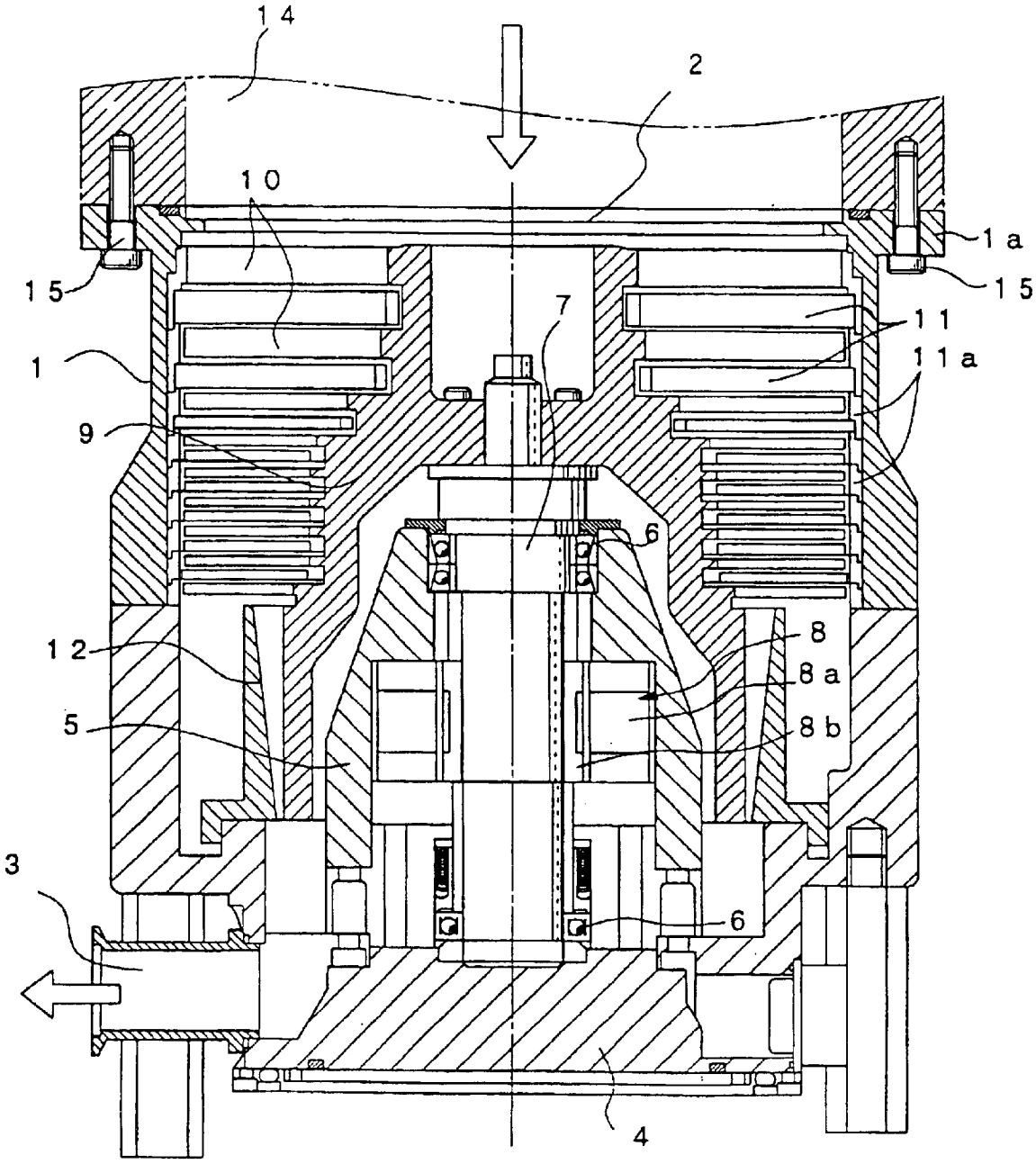
FIG. 1 is a front sectional view of the entire structure of a vacuum pump according to the present invention.

Vacuum pumps according to preferred embodiments of the present invention will be described in further detail with reference to the accompanying drawings. Since the basic structure of a vacuum pump is the same as that of the conventional pump shown in FIG. 1, the entire explanation thereof will be omitted and the same numerals and symbols will be used to designate the same component and the different symbols will be employed to designate only the necessary components in the description.

Figure 2:
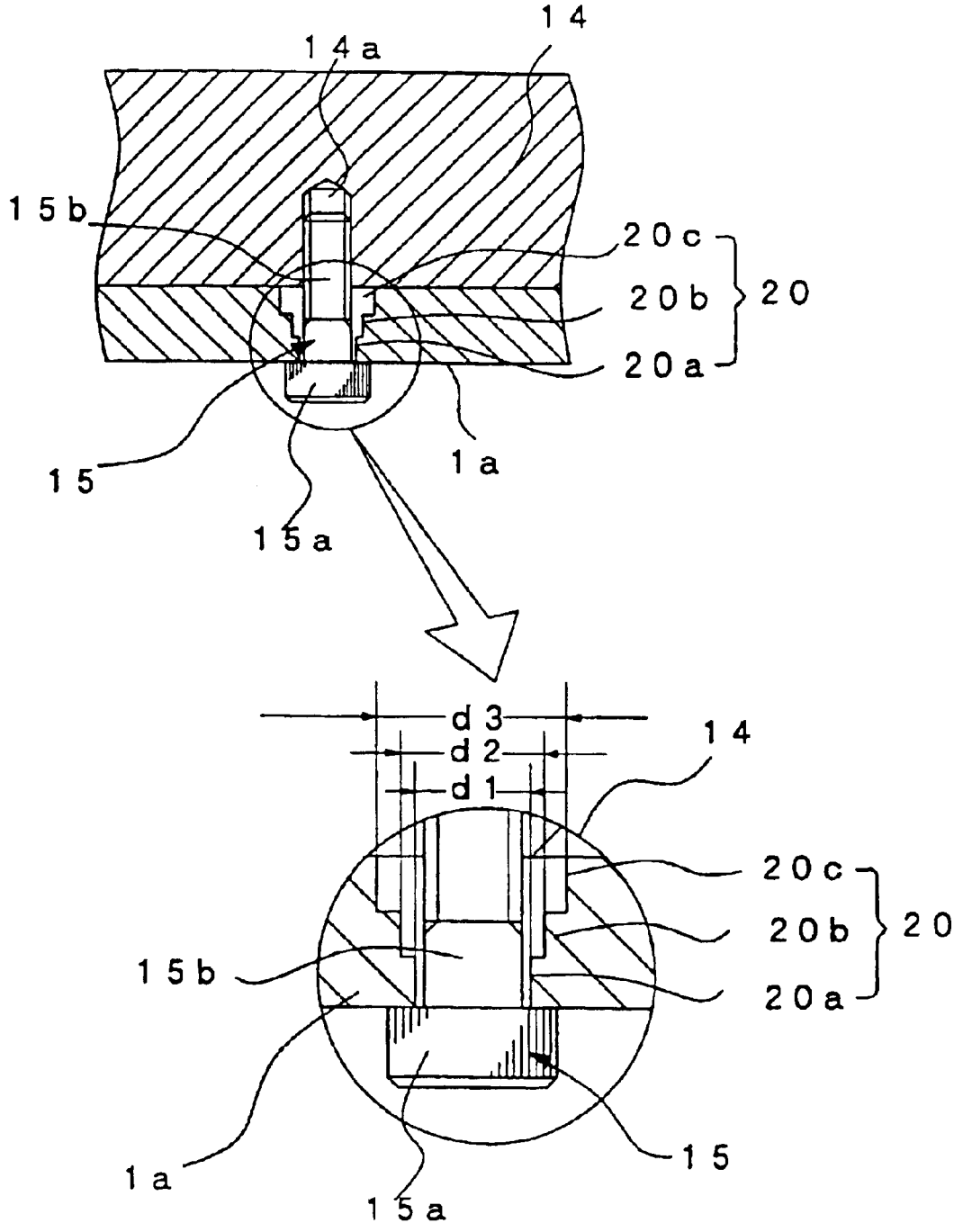
FIG. 2 is a partial front view in section illustrating the connecting structure of a flange and a chamber of a vacuum pump according to a first embodiment of the present invention.
Figure 3:
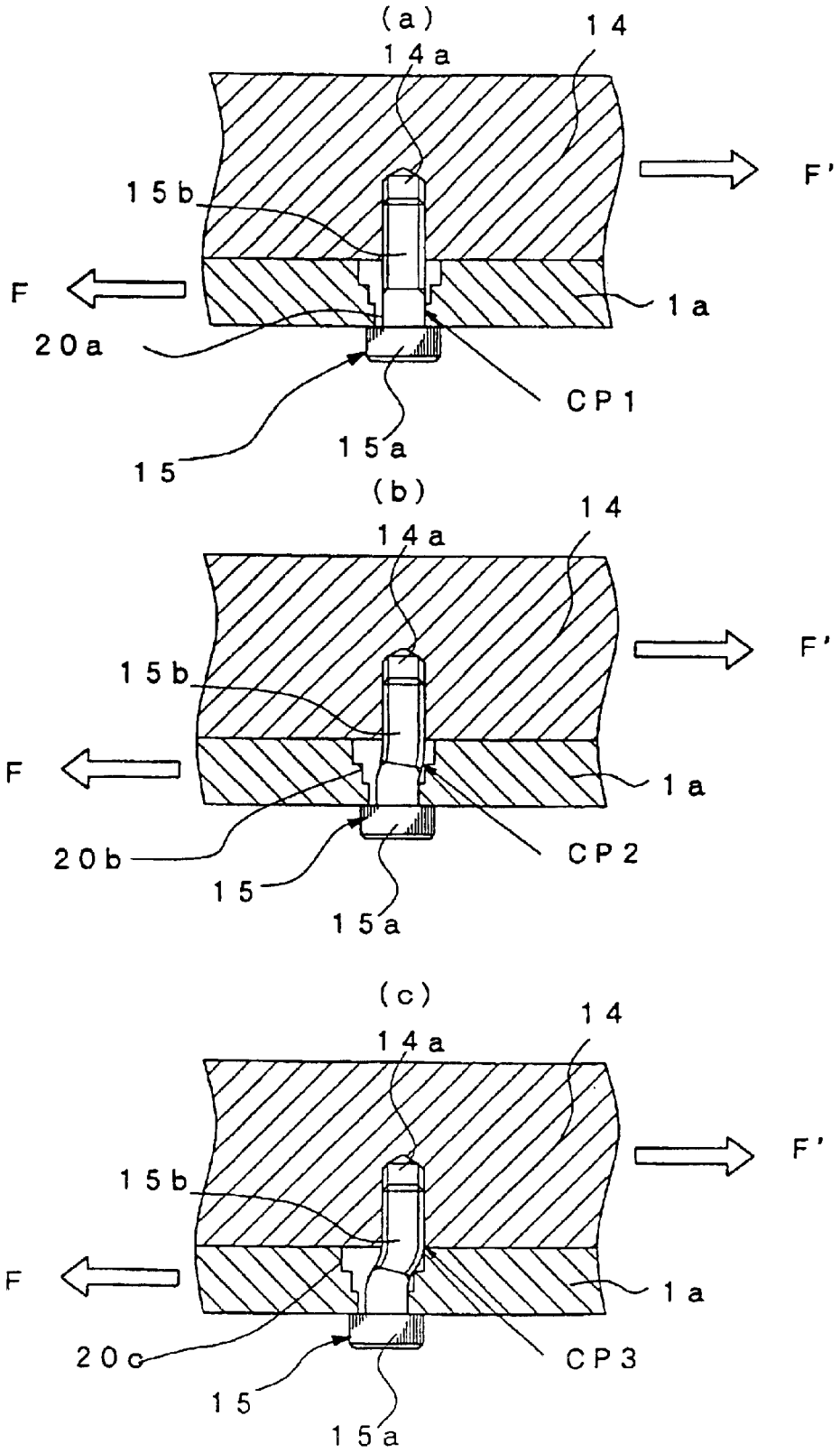
FIGS. 3(*a*) to 3(*c*) are partial front views in section illustrating a process in which a damaging torque is generated.

FIGS. 2 and 3 show a first embodiment of a vacuum pump according to the present invention, wherein these Figures show a partial front view in section of a flange 1*a* and FIG. 2 shows the structure of the first embodiment and FIGS. 3(*a*) to 3(*c*) show the manner in which a damaging torque is generated.

The bolt 15 is of a commonly used type formed of stainless steel and has a hexagon-socket bolt head 15*a* and a bolt shaft 15*b* integrated with the bolt head 15*a*. The bolt shaft 15*b* has a male-threaded portion formed thereon so as to have a given thread pitch.

The chamber 14 has a plurality of female-threaded portions 14*a* formed in the circumferential fixing portion thereof along the circumferential upper surface of the flange 1*a*. Each female-threaded portion 14*a* has the same thread pitch as that of the male-threaded portion formed on the bolt shaft 15*b*.

Although the figures illustrate only one connecting structure, the number of the fastening bolts 15 is in the order of 8 to 12 depending on the diameter of the pump case 1 and the corresponding number of the female-threaded portions 14*a* are formed in the fixing portion of the chamber 14 at a same interval in the circumferential direction of the flange 1*a*.

A bolt insertion hole 20 is formed in the flange 1*a* so as to correspond to the female-threaded portions 14*a*. The cross section of the bolt insertion hole 20 has three steps 20*a*, 20*b*, and 20*c* having greater diameters step by step toward the fixing surface of the flange 1*a* in this embodiment. The first step 20*a* has a diameter d1, the same as that of a typical bolt insertion hole, the second step 20*b* has a diameter d2 slightly greater than d1, and the third step 20*c* has the maximum diameter d3.

In the vacuum pump having the above-described structure, when some kind of problem occurs and thus causes breaking forces F and F', which are equal to each other but act in the opposite directions, to be produced in the pump case 1 in the circumferential direction thereof, first, as shown in FIG. 3(*a*), the flange 1*a* moves in the circumferential direction thereof due to the forces F and F' which are greater than the fastening force of the bolt 15. As a result, the bolt shaft 15*b* abuts against the inner wall of the first step 20*a* of the insertion hole 20 and then the bolt shaft 15*b* is bent at a contact point CP1 contacting with the upper edge of the first step 20*a* due to a shearing force produced at the contact point CP1. Then, as shown in FIG. 3(*b*), the bolt shaft 15*b* is further bent at a contact point CP2 contacting with the upper edge of the second step 20*b*.

Furthermore, as shown in FIG. 3(*c*), the bolt shaft 15*b* is further bent at a contact point CP3 contacting with the upper edge of the third step 20*c* and also experiences a shearing force produced by the mutual slide between the fixing surfaces of the flange 1*a* and the chamber 14.

Although the above-described movement occurs instantaneously, since the bolt shaft 15*b* experiences bending moments in a time sequential manner at the three points from the steps 20*a* to 20*c*, and also at the fixing surfaces, the shearing forces due to the bending moment do not concentrate on one point of the bolt shaft. Also, the flange 1*a* absorbs a shock by moving in the circumferential direction thereof during this time period of operation. Since the bolt shaft 15*b* simply experiences a plastic deformation as shown in FIG. 3(*c*), the above-described structure prevents the transfer of the damaging torque to the chamber 14, thereby preventing the chamber 14 from being damaged and also the breaking of the bolt 15. Accordingly, the damaged vacuum pump can be quickly replaced with a new one without tapping since the broken bolt 15 can be extracted from the chamber 14 by using, for example, a wrench.

In the first embodiment shown in FIGS. 2 to 3(*c*), a buffer member having a large diameter shown in FIG. 4, which will be described later, or another buffer member filling the overall gap between the bolt 15 and the bolt insertion hole 20 may be used.

Figure 4:
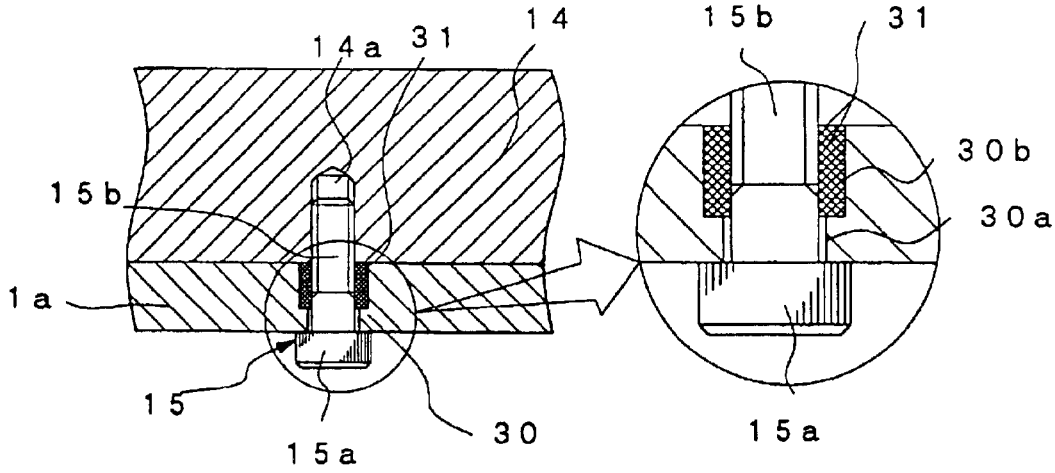
FIG. 4 is a partial front view in section illustrating a second embodiment according to the present invention.
Figure 5:
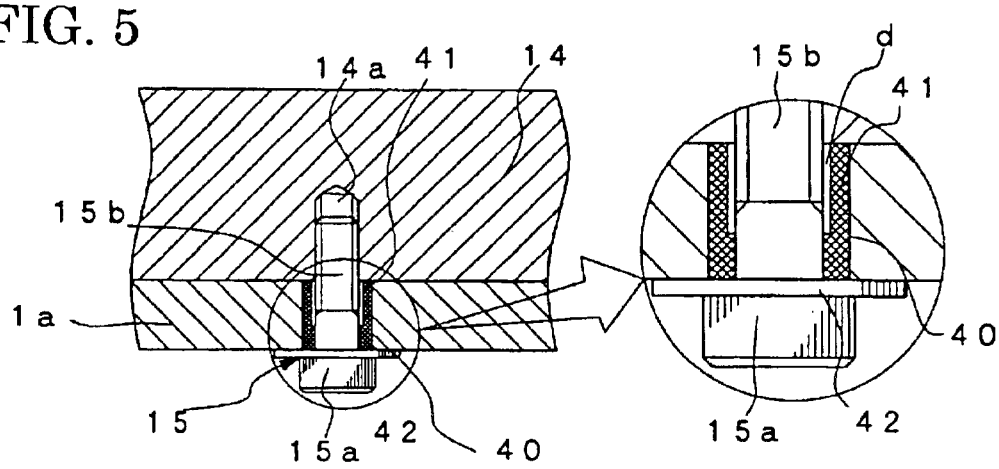
FIG. 5 is a partial front view in section illustrating a modification of the second embodiment according to the present invention.
Figure 6:
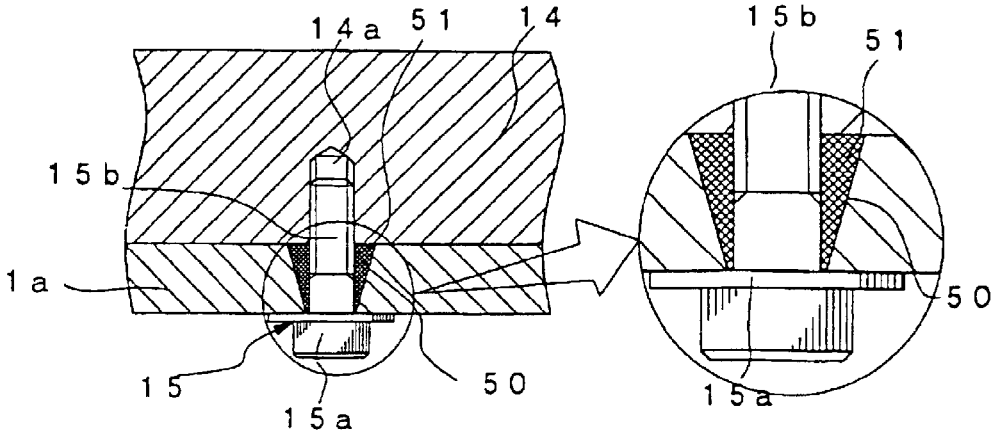
FIG. 6 is a partial front view in section illustrating another modification of the second embodiment according to the present invention.

FIGS. 4 to 6 show the second embodiment, using a buffer member, and the modifications according to the second embodiment.

As shown in FIG. 4, a bolt insertion hole 30 formed in the flange 1*a* has two steps, i.e., a small-diameter step 30*a* and a large-diameter step 30*b* on the step 30*a*, and a cylindrical buffer member 31 is filled in the gap between the large step portion 30*b* and the bolt shaft 15*b*. The buffer member 31 is formed of a rubber material or the like used for an O-ring. The small-diameter step 30*a* defines a smaller diameter portion of the bolt insertion hole 30 which opens at the lower surface of the flange 1*a*, and the large-diameter step 30*b* defines a larger diameter portion of the hole 30 which opens at the upper surface of the flange 1*a* facing the underside of the chamber 14.

In the second embodiment shown in FIG. 4, when the damaging torque is generated, the shearing forces exerted on the bolt shaft 15*b* are dispersed because the bolt shaft 15*b* contacts the upper edge of the small-diameter step 30*a* and then the upper edge of the large-diameter step 30*b* in a similar fashion to that in the first embodiment, and additionally, the elastically deformed buffer member 31 provides a buffer effect. As a result, the above-described dispersion of the shearing forces and buffer effect prevent the transfer of the damaging torque to the chamber 14, thereby preventing the chamber 14 from being damaged and also the bolt 15 from being broken.

FIG. 5 shows a modification according to the second embodiment. As shown in FIG. 5, a large-diameter bolt insertion hole 40 having a straight cylindrical wall is formed in the flange 1*a* and the bolt shaft 15*b* passes through the bolt insertion hole 40 having a buffer member 41 interposed therebetween. Also, the male-threaded portion of the bolt shaft 15*b* is screwed in and fixed to the female-threaded portion 14*a* of the chamber 14. The straight cylindrical buffer member 41, which is forced and fitted into the bolt insertion hole 30, has an upper portion having an inner diameter larger than the diameter of the bolt shaft 15*b* so as to form a predetermined gap d between the foregoing upper portion and the bolt shaft 15*b*. In addition, a flat washer 42 is interposed between the bolt head 15*a* and the flange 1*a* so as to increase a contact area of the bolt head 15*a* with the flange 1*a* via the flat washer 42.

According to the modification shown in FIG. 5, in addition to a buffer effect due to the elastic deformation of the buffer member 41, the gap d formed around the upper portion of the bolt shaft 15*b* provides the bolt shaft 15*b* with a sufficient space for the plastic deformation, and the flat washer 42 lying between the bolt head 15*a* and the bolt insertion hole 40 allows the bolt 15 to move. Accordingly, the above-described structure prevents the transfer of the damaging torque to the chamber 14, thereby preventing the chamber 14 from being damaged and also the breaking of the bolt 15.

As shown in FIG. 6 illustrating the other modification, a bolt insertion hole 50 having an upwardly-enlarging tapered shape is formed in the flange 1*a*, and a buffer member 51 having a truncated cone shape is filled in the gap between the bolt insertion hole 50 and the bolt shaft 15*b*.

According to the other modification shown in FIG. 6, since the buffer member 50 having a geometrical shape along which the bolt shaft 15*b* is likely deformed due to an assumed bending moment is disposed in the above-described manner, the buffer member 50 provides the bolt shaft 15*b* with a uniform buffer effect along its deformed portion. Accordingly, the above-described structure prevents the transfer of the damaging torque to the chamber 14, thereby preventing the chamber 14 from being damaged and also the bolt 15 from being broken.

In the connecting structure shown in FIG. 6, the buffer member 51 may be eliminated.

Next, the use of an extending bolt for connecting the flange 1*a* to the chamber 14 according to the present invention will be described below with reference to FIGS. 7 and 8.

Figure 7:
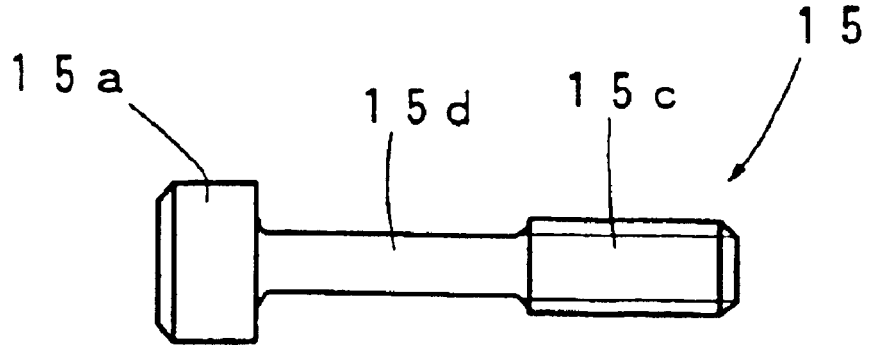
FIG. 7 is a front view of an extending bolt used for connecting the flange to the chamber according to the present invention.

As is well known, the extending bolt shown in FIG. 7 has a reduced-diameter portion 15*d*, as a part of the bolt shaft 15*b*, between the bolt head 15*a* and the male-threaded portion 15*c*. The diameter of the reduced-diameter portion 15*d* is formed so as to be smaller than the root diameter of the male-threaded portion 15*c* such that the reduced-diameter portion 15*d* extends so as to prevent components in the vicinity of the bolt from being damaged when an extraordinary load is exerted on the bolt.

By using this extending bolt as the fastening bolt 15, the transfer of the damaging torque and the breaking of the bolt are further reliably prevented.

Figure 8:
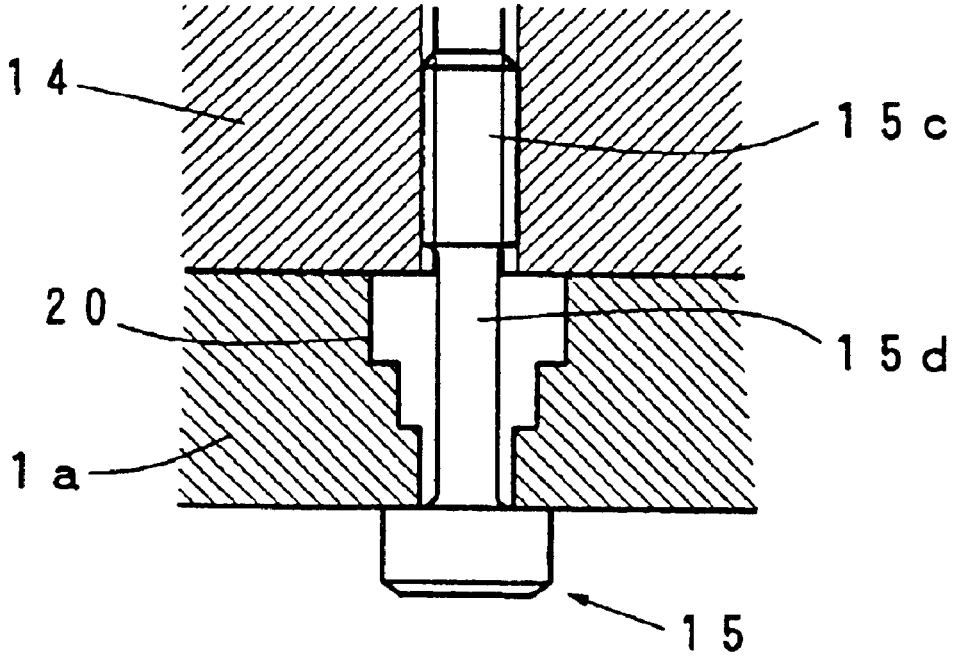
FIG. 8 is a partial front view in section illustrating an example of the extending bolt shown in FIG. 7 applied to to the second embodiment.

FIG. 8 shows an example of using an extending bolt. The way of preventing the transfer of the damaging torque and the breaking of the bolt by using the extending bolt 15 will be described in reference to FIG. 8. The extending bolt 15 is screwed into the female-threaded portion 14*a* of the chamber 14 such that the top of the reduced-diameter portion 15*d* enters the chamber 14 by the length of one or two threads of the bolt 15. The reduced-diameter portion 15*d* and the female-threaded portion 14*a* of the chamber 14 have a space therebetween. When the damaging torque is exerted on the flange 1*a* in this state, although the extending bolt 15 experiences shearing and tensile forces in a similar fashion to that shown in FIG. 3, the reduced-diameter portion 15*d* of the extending bolt 15 extends and bends in a spacious bolt insertion hole 20. In an extraordinary case, the reduced-diameter portion 15*d* is broken. Accordingly, the portions of the bolt 15 other than the reduced-diameter portion 15*d*, including the male-threaded portion 15*c*, are not deformed and the kinetic energy due to the damaging torque is absorbed by the deformation of the reduced-diameter portion 15*d* of the extending bolt 15.

As a result, the male-threaded portion 15*c* and the female-threaded portion 14*a* are not deformed at all, thereby allowing the broken fastening bolt 15 to be easily extracted from the female-threaded portion 14*a* of the chamber 14.

Also in the embodiment shown in FIG. 8, a buffer member can be filled in the upper part or the entire part of the gap between the extending bolt 15 and the bolt insertion hole 20.

As is seen from the above description, since the vacuum pump according to the present invention has a structure in which the bolt insertion hole formed in the flange has a plurality of steps which increase in size towards the top step by step, damage to the chamber caused by the damaging torque transferred to the chamber can be prevented and also the breaking of the bolt for connecting the vacuum pump to the chamber can be prevented, thereby allowing the damaged vacuum pump to be quickly replaced with a new one.

What is claimed is:

1. A vacuum pump comprising:

a pump case having a gas suction port at an upper part of the pump case, a gas exhaust port at a lower part of the pump case, and a flange extending circumferentially around a top portion of the rump case;

a rotor rotatably supported in the pump case by a stator column via a rotor shaft, the rotor having a plurality of rotor blades fixed to the circumferential outer surface thereof;

a plurality of stator blades fixed to the circumferential inner surface of the pump case, the rotor blades and the stator blades being alternately disposed;

a driving motor disposed between the rotor shaft and the stator column for rotationally driving the rotor;

a plurality of bolts for connecting the flange of the pump case to a circumferential bottom portion of a chamber;

a plurality of bolt insertion holes provided in the flange of the pump case and having stages which increase in size step by step toward a fixing surface of the chamber; and a plurality of buffer members disposed between respective ones of the bolt insertion holes and the bolt shaft of the corresponding bolt.

2. The vacuum pump according to claim 1; wherein the bolt insertion holes have two steps having large and small diameters and the buffer members are disposed between the bolt shaft and the large step portion close to the chamber.

3. The vacuum pump according to claim 1; further comprising a washer disposed between each bolt head and the flange, and wherein each buffer member has an insertion hole for the bolt shaft to pass therethrough, the bolt shaft and the upper part of the buffer member having an enlarged inner diameter with a gap therebetween.

4. The vacuum pump according to claim 1; wherein each bolt insertion hole has a tapered shape which increases in size toward the fixing surface of the chamber, and each buffer member has a truncated cone shape disposed between the bolt shaft and the bolt insertion hole.

5. The vacuum pump according to claim 1; wherein each bolt is an extending bolt having a reduced-diameter portion between the bolt head and a male-threaded portion thereof, and the diameter of the reduced-diameter portion is smaller than the root diameter of the male-threaded portion.

6. The vacuum pump according to claim 5; wherein each extending bolt is screwed into the chamber such that the top of the reduced-diameter portion enters the chamber by the length of one or two threads of the bolt.

7. The vacuum pump according to claim 1; wherein the buffer members are formed of a rubber material.

8. A vacuum pump removably connectable to the underside of a chamber for exhausting gas molecules from the chamber, the vacuum pump comprising: a pump case having a flange extending circumferentially around a top portion thereof, a suction port and an exhaust port; a plurality of stator blades fixedly mounted within the pump case; a rotor rotatably mounted in the pump case and having a plurality of rotor blades alternately disposed with respect to the stator blades; a driving motor connected to rotationally drive the rotor whereby the rotating rotor blades coact with the stator blades to evacuate gas molecules from the chamber and pump the gas molecules from the suction port to the exhaust port; a plurality of bolt insertion holes formed in the flange, each bolt insertion hole having a smaller diameter portion opening at a lower surface of the flange and a larger diameter portion opening at an upper surface of the flange which faces the underside of the chamber; a plurality of bolts extending through respective ones of the bolt insertion holes for removably connecting the flange of the pump case to the underside of the chamber; and a plurality of buffer members disposed in respective ones of the bolt insertion holes and surrounding at least a portion of the corresponding bolt in the region between the upper and lower surfaces of the flange.

9. A vacuum pump according to claim 8; wherein the buffer members extend completely from the lower surface to the upper surface of the flange.

10. A vacuum pump according to claim 8; wherein the buffer members extend only part way from the upper surface to the lower surface of the flange.

11. A vacuum pump according to claim 8; wherein the buffer members are comprised of rubber material.

12. A vacuum pump according to claim 8; wherein the stator blades are connected to and extend radially inwardly from the pump case; and the rotor blades are connected to and extend radially outwardly from the rotor.

13. A vacuum pump according to claim 8; wherein the bolts have a reduced-diameter portion in the region between the upper and lower surfaces.

14. A vacuum pump according to claim 8; wherein the bolt insertion holes have a stepped configuration.

15. A vacuum pump according to claim 14; wherein the stepped configuration has two steps.

16. A vacuum pump according to claim 14; wherein the stepped configuration has three steps.

17. A vacuum pump according to claim 14; wherein the buffer members are comprised of rubber material.

18. A vacuum pump according to claim 8; wherein the bolt insertion holes have a tapered configuration which tapers outwardly in a direction from the lower surface to the upper surface of the flange.

19. A vacuum pump according to claim 18; wherein the buffer members are comprised of rubber material.

* * * * *